US009878533B2

(12) United States Patent
Sonnauer

(10) Patent No.: US 9,878,533 B2
(45) Date of Patent: Jan. 30, 2018

(54) METHOD AND DEVICE FOR INK-JET PRINTING ONTO CONTAINERS

(71) Applicant: KRONES AG, Neutraubling (DE)

(72) Inventor: Andreas Sonnauer, Woerth (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 14/963,110

(22) Filed: Dec. 8, 2015

(65) Prior Publication Data

US 2016/0159087 A1 Jun. 9, 2016

(30) Foreign Application Priority Data

Dec. 9, 2014 (DE) ..... 10 2014 225 256

(51) Int. Cl.
*B41J 3/407* (2006.01)
*B41J 2/045* (2006.01)

(52) U.S. Cl.
CPC ..... *B41J 2/04526* (2013.01); *B41J 2/04586* (2013.01); *B41J 3/4073* (2013.01); *B41P 2217/62* (2013.01)

(58) Field of Classification Search
CPC ..... B41J 3/4073; B41J 3/283; B41P 2217/00; B41P 2217/61; B41P 2217/62
See application file for complete search history.

(56) References Cited

U.S. PATENT DOCUMENTS 5,835,106 A * 11/1998 No ..... B41J 3/4073 347/104
9,090,091 B2 7/2015 Till
2005/0248618 A1* 11/2005 Pinard ..... B41J 3/4073 347/54
2005/0258618 A1 11/2005 Pinard et al.
2010/0283825 A1 11/2010 Vila Closas
2011/0146880 A1* 6/2011 Kramer ..... B65C 9/067 156/64

(Continued)

FOREIGN PATENT DOCUMENTS

CN 103935136 A 7/2014
DE 102008051791 A1 4/2010

(Continued)

OTHER PUBLICATIONS

Inkjet printer for monitoring media movement, has friction wheel lying on top of media surface and including shaft that is connected to rotary encoder to measure angle rotated by friction wheel. Jun. 10, 2003 RD 470012A.*

(Continued)

*Primary Examiner* — Sharon A Polk
(74) *Attorney, Agent, or Firm* — McCoy Russell LLP

(57) ABSTRACT

A method and a device for ink-jet printing onto containers is described, in which at least one container is rotated and/or transported along a curved path, and associated surface velocities of partially circumferential portions of a lateral container surface are measured, where the printing times and/or a rotational velocity of the containers associated with the partially circumferential and/or intermediately disposed portions are adapted to the surface velocities. Changes in the print advance rate caused by different surface velocities in front of print heads can thereby be compensated. This allows for uniform print resolution and seamless joining of partial prints.

20 Claims, 4 Drawing Sheets

(56) References Cited

U.S. PATENT DOCUMENTS

| | | | | |
|---|---|---|---|---|
| 2011/0273726 | A1* | 11/2011 | Beckhaus | B41F 17/18 356/620 |
| 2012/0017783 | A1* | 1/2012 | Uptergrove | B41J 3/4073 101/38.1 |
| 2014/0204135 | A1* | 7/2014 | Fischer | B41J 29/393 347/2 |
| 2015/0298467 | A1* | 10/2015 | Cofler | B41J 3/4073 347/16 |

FOREIGN PATENT DOCUMENTS

| | | | |
|---|---|---|---|
| DE | 102013000888 | A1 | 7/2014 |
| EP | 2239144 | A2 | 10/2010 |
| EP | 2756956 | A1 | 7/2014 |
| EP | 2860036 | A1 | 4/2015 |
| EP | 2459385 | B1 | 12/2016 |
| WO | WO 8605142 | A * | 9/1986 |
| WO | 2010108527 | A1 | 9/2010 |

OTHER PUBLICATIONS

Anonymous, "Monitoring print media advance in hardcopy apparatus," Research Disclosure database No. 470012, Jun. 2003, 2 pages.

State Intellectual Property Office of the People's Republic of China, Office Action and Search Report Issued in Application No. 201510903672.8, Jul. 19, 2017, 19 pages. (Submitted with Translation of Office Action).

* cited by examiner

METHOD AND DEVICE FOR INK-JET PRINTING ONTO CONTAINERS

CROSS REFERENCE TO RELATED APPLICATIONS

The present application claims priority to German Patent Application No. 102014225256.3, entitled "METHOD AND DEVICE FOR INK-JET PRINTING ONTO CONTAINERS," filed on Dec. 9, 2014, the entire contents of which are hereby incorporated by reference for all purposes.

FIELD OF THE INVENTION

The invention relates to a method and a device for ink-jet printing onto containers.

BACKGROUND AND SUMMARY OF THE INVENTION

When directly printing onto containers, such as bottles, a print advance rate of the surface to be printed on relative to at least one ink-jet print module is achieved in that the container is in the region of the print module rotated about itself and/or passed by the print module along a predetermined transport path. A plurality of partial prints is, after setting a suitable rotational orientation of the container and while maintaining a print advance rate as constant as possible, then combined at the respectively associated print heads or nozzle rows to create one print image in a direct printing process.

To print onto containers at a known rotational velocity and at a known rotational orientation about their main axis, it is known from WO 2010/108527 A1 to position the containers to be printed onto turntables, where line markings or the like are applied at the circumference of the turntable with even spacing for monitoring the rotational orientation of the container. The latter can thereby be adjusted relatively accurately in front of print heads.

The problem remains, however, that the dimensional and/or shape tolerances of the container, for example, unwanted eccentricity of the container cross-section, cause print advance rates of different velocities of the surface to be printed on in front of the associated print heads or nozzle rows when rotating the container about itself or when moving it along curved transport paths. These fluctuations in the effective local print advance rate in the case of conventional nozzle control have the effect that the resolution of the ink-jet print, i.e. the spacing between each ink droplet, varies along the container circumference. Moreover, connecting regions with overlapping prints or with gaps arise when assembling the partial print images that have been created by use of different print heads or nozzle rows.

Due to the manufacturing process, in particular glass bottles exhibit relatively large tolerances in dimensions and shapes. When rotating glass bottles with a rotationally-symmetrical nominal cross-section, for example, the container wall laterally impacts due to its eccentricity, which has previously prevented commercial use of ink-jet direct printing onto glass bottles.

Similar problems exist for ink-jet direct printing onto shaped bottles that are by definition not rotationally-symmetrical. Though it is known from EP 2 459 385 B1 to adapt the position and orientation of ink-jet print heads to the contour of shaped bottles to be printed on, there is nevertheless the aforementioned problem also for shaped bottles of varying print resolution and/or excessive overlap and/or incomplete assembly of partial prints due to the varying radii of the trajectories of individual circumferential portions of the container sidewall.

Due to the high print resolution commonly demanded, print heads may be used that have a plurality of nozzle rows. Such nozzle rows or nozzle blocks have defined offsets relative to each other. If a predetermined print advance rate is departed from, then undesirable distortions in resolution of the pixels and double prints arise.

A need for methods and devices for ink-jet printing onto containers therefore exists in which at least one of the above-mentioned problems is eliminated or at least alleviated.

This object posed is satisfied by a method according to claim 1. This method therefore serves ink-jet printing onto containers, where a print advance rate in front of at least one print module is achieved at least by rotating the containers about themselves and/or by transporting the containers along at least one curved trajectory, in particular by circulating them on a carousel. The surface velocities of lateral portions of the containers are there measured during the rotation and/or the transport. Furthermore, time intervals between printing times of the print module and/or an angular velocity of the rotation of the containers about themselves are set in dependence of the measured surface velocities. The latter then correspond to actual print advance rates of individual lateral portions of the containers relative to the print module.

The measured surface velocities can be caused solely by rotation of the containers about themselves, i.e. by rotation about an axis that is stationary relative to the print module, or by superimposing the container rotation about itself a transport motion of the containers, i.e. by rotating the containers about an axis of rotation that moves relative to the print module, for example, along a linear transport path or along a curved transport path. Both linear conveyors as well as carousels or otherwise curved conveying stretches are suitable for this.

The measured surface velocities can likewise be caused solely by circulating the containers in a carousel or by a motion along otherwise curved transport paths. The rotational orientation of the containers about themselves is then respectively adjusted upstream of the velocity measurement according to the invention.

For example, it is possible that the containers are on a carousel or a similar transport device and pass along the print module and are there during printing also rotated about themselves. Print advance is then achieved by superimposition of the transport motion and rotating the container about itself. In all the cases described above, the surface velocity measured according to the invention is representative of the actual print advance rate of each sampled lateral portion of the container surface.

The lateral portions are, for example, partially circumferential portions of a side wall to be printed on/or representative of its circumferential line. The lateral portions can directly adjoin one another, for example, when continuously sampling the surface along the container circumference. The lateral portions can also be spaced apart, within the meaning of a measurement point grid pattern extending along the container circumference. Printing times and associated time intervals can be calculated for lateral portions between the measuring points of the grid pattern, for example, by interpolation of readings. The lateral container surface is optionally sampled from a position which is stationary relative to the print module.

By adapting the printing times and/or the angular velocity of the container rotation about itself, deviations of the actual print advance rate of individual lateral and/or intermediate portions of the container from the target print advance rate can be compensated with respect to at least one print head and/or with respect to a nozzle row oriented in particular transverse to the advance direction, in order to produce a print resolution in the advance direction that is as uniform as possible.

By adapting the angular velocity, i.e. the rotational velocity of the containers about themselves, deviations of the reference advance rate of individual lateral and/or intermediate portions of the container from a target advance rate can be compensated with respect to at least one print head and/or with respect to a nozzle row oriented in particular transverse to the advance direction, in order to produce a print resolution in the advance direction that is as uniform as possible. For example, the angular velocity/rotational velocity is for a measured deviation from a target value of the angular velocity/rotational velocity and thereby from the print advance rate readjusted in order to keep the deviation within an allowable tolerance range.

For this purpose, for example, courses of the angular velocity/rotational velocity can be created for an entire or partial circumferential rotation of the container about itself and possibly be stored in order to reproducibly alter the angular velocity/rotational velocity in front of different printheads such that a respective substantially constant print advance rate of the surface to be printed on arises in front thereof.

This would be conceivable, for example, for carousels at which a specific color is printed or a specific treatment step is performed. The individual container or container type can then be assigned an individual course or rotational velocity that the container maintains for the individual print modules or pre-/post-treatment modules on its way through the device according to the invention, for example, through multiple carousels.

Time intervals being associated with the different lateral portions and/or intermediate portions may be set respectively greater, the lower the associated surface velocities. Adapting the printing times is therefore to be understood such that, for lateral portions with a relatively high surface velocity, print commands for a print head for a nozzle row oriented transversely to the advance direction and/or for a single nozzle are given having comparatively short time lags to each other, and for lateral portions with comparatively low surface velocity in contrast with larger time lags. This allows an actual print advance rate of the container surface of different velocities along the container circumference to be compensated in order to place ink droplets thereon at a spacing in the advance direction as uniform to each other as possible.

The time intervals between printing times of individual nozzles and/or nozzle rows of the print module may be defined, in particular between immediately successive printing times. The adapted time intervals are associated with the lateral portions of the container surface and can thereby be applied to nozzles and/or nozzle rows of different print heads or print modules in order to adapt ejection of ink to the respective actual print advance rate. Unwanted print artifacts at the transition between partial prints produced with different nozzle rows, printheads and/or print modules, for example, an overlapping print or connection gaps, can thereby be suppressed.

The surface velocities may be measured during ongoing print advance, in particular during ink-jet printing. This is to be understood such that the motion responsible for print advance is from measuring the surface velocities to the associated print process not interrupted. The rotational position of the container then does not necessarily need to be determined for the adaptation of printing times according to the invention. The printing times can instead be adapted essentially on-the-fly, for example, during rotation at a constant angular velocity and in consideration of a time offset until the respective nozzle or nozzle row is reached. This is advantageous in particular for glass bottles, for which the individual dimensional and shape tolerances are in the foreground, so that printing times for every bottle must be corrected individually.

The surface velocities may be measured at a known angular velocity during rotation and/or transportation. The known angular velocity is optionally constant, but can be varied, provided that the measured surface velocity of the angular velocity there applied can be allocated. The angular velocity can further also be re-adjusted or controlled in order to reduce or compensate any deviation of the measured actual print advance rate from a target print advance rate. This may be done on-the-fly or in the form of a previously stored course of the angular velocity. The known angular velocity can be overlaid by a transport velocity likewise known, for example, along a linear conveyor section.

Alternatively or additionally, the measured surface velocities are each associated with measured rotational positions of the container. Readings can be, for example, stored together and also be used for subsequent print processes to calculate printing times and/or adapted courses of the angular velocity. The fluctuations of the surface velocity of individual lateral portions, caused by eccentrically held and/or non-rotationally-symmetrical container cross-sections, could in principle also be measured and stored in an upstream method step. Time intervals between printing times and/or angular velocities associated with individual rotational positions of the container can subsequently be repeatedly used for any number of printing processes of the same lateral portions. This is advantageous for shaped bottles made of plastic, whose deviation from a rotationally-symmetrical cross-section is defined and which have minor individual dimensional and shape tolerances as compared to glass bottles.

The surface velocities may be measured using a friction wheel rolling laterally along the container, a functionally equivalent roller or the like. Coupled thereto is, for example, a rotary encoder for accurate digital velocity measurement. The friction wheel can be adjusted, for example, in the vertical direction to sample the container sidewall on a height level that is representative of the wall contour to be printed on. The friction wheel then may roll along the entire circumference of the container. Friction wheels are particularly suitable for bottles with rotationally-symmetrical nominal cross-section.

Alternatively or additionally, the surface velocities can be measured in a contactless manner by optical scanning of the lateral portions and/or by acoustic sensing by way of ultrasound. This is particularly advantageous for large relative velocities between the container surface to be measured and the measuring device and/or a short residence time of the container in the region of the measuring device/the print module.

The printing times and/or the angular velocity may also be adapted to print distances from the lateral portions of the containers and/or intermediately disposed portions. Runtime differences of individual ink droplets from the nozzles to the portions of the container surface to be printed on can thereby be compensated.

The containers are optionally glass bottles, in particular such with rotationally-symmetrical nominal cross-section, or shaped bottles, in particular such made of plastic. Glass bottles have particularly high dimensional and shape tolerances due to their fabrication method, in particular in terms of their outer circumference and their eccentricity toward the bottle mouth. Compensation of different actual print advance rates of individual sidewall portions by adapting the associated printing times is therefore particularly important for glass bottles or even a prerequisite in terms of acceptable quality when using direct printing by way of ink-jet.

Due to the non-rotationally-symmetrical nominal cross-section, shaped bottles inevitable and in a possibly particularly pronounced manner exhibit different actual print advance rates of individual sidewall portions both during rotation about themselves as well as during transport along curved trajectories, respectively, following a rotation about themselves. Printing times adapted according to the invention even enable prints with uniform print resolution in the advance direction on container cross-sections having a complex shape.

The object is also satisfied by a device according to claim 11. According thereto, it is used for ink-jet printing onto containers and comprises: at least one print module; at least one positioning unit for holding and rotating a container about itself in front of the print module; at least one measuring device for determining surface velocities of lateral portions of the rotating container; and a control device for actuating the print module while adapting time intervals between printing times of the print module in dependence of the measured surface velocities. The device is then, for example, a cyclically operated device of the stationary type in which the containers do not circulate in a carousel, or a device of the rotary type, in which the print modules circulate together with the containers. It is also conceivable that the containers held by the positioning unit continuously pass by along the at least one print module, for example, along a transport stretch extending linearly in the region of the print module.

The object is also satisfied by a device according to claim 12. According thereto, it is used for ink-jet printing onto containers and comprises: at least one print module; a carousel with positioning units circulating therein for holding and rotating the container about themselves; at least one measuring device for determining the surface velocities of lateral portions of the circulating containers; and a control device for actuating the print module while adapting time intervals between printing times of the print module in dependence of the measured surface velocities.

The containers can be rotated both in front of stationary print modules to create a print advance, as well as in front of circulating print modules. For example, the print modules could each circulate on carousels through which the containers pass in series, where the carousels then may be each assigned a particular color of a color model or perform a specific pretreatment step/post-treatment step, such as curing.

Carousels being assigned a certain partial print step or treatment step can be modularly inserted in the serial sequence of carousels or removed therefrom according to the required color and/or processing steps. The succession of carousels could be added inlet modules and outlet modules. The containers could for printing further be inserted into transport adaptors or other transport/positioning aids.

Measurement of the surface velocity according to the invention can be applied selectively for the correction of printing times and/or the adaptation of the angular velocity/rotational velocity of the containers for printing individual circumferential partial portions using a specific print head.

Printheads and units for curing print could also be formed in a common horizontal plane, in particular in star configuration around a positioning unit for holding and rotating a container about itself. Measurement of the surface velocity according to the invention can then be used for correcting printing times at the printhead or the like which is currently facing the measured surface.

Adaptation of printing times/rotational velocities according to the invention could likewise be used for print modules in which the printheads are arranged one above the other, i.e. the containers are for partial print change/print head change driven along their longitudinal axis and may be printed in different horizontal planes.

The measuring device may comprise a friction wheel with a rotary encoder, where the friction wheel is resiliently preloaded in the direction of the container to be sampled. The friction wheel can in a simple manner be coupled directly to the print module.

The printhead and the friction wheel are supported or optionally mounted jointly movable in the direction of the container. When the friction wheel then rolls along the container, a constant print distance between the container surface and the nozzles/nozzle rows of the print module then arises. The friction wheel then acts as a guide roller for the nozzles/nozzle rows. The container surface then acts as a corresponding guide curve.

The measuring device may operate in a contact-less manner on the basis of an optical and/or acoustic scanning beam. Scanning is then performed, for example, by way of laser light or ultrasound. Optical code readers, line scanners, cameras or the like are suitable for optical scanning.

BRIEF DESCRIPTION OF THE FIGURES

Example embodiments of the invention are illustrated in the drawing, where.

DETAILED DESCRIPTION

Figure 1:
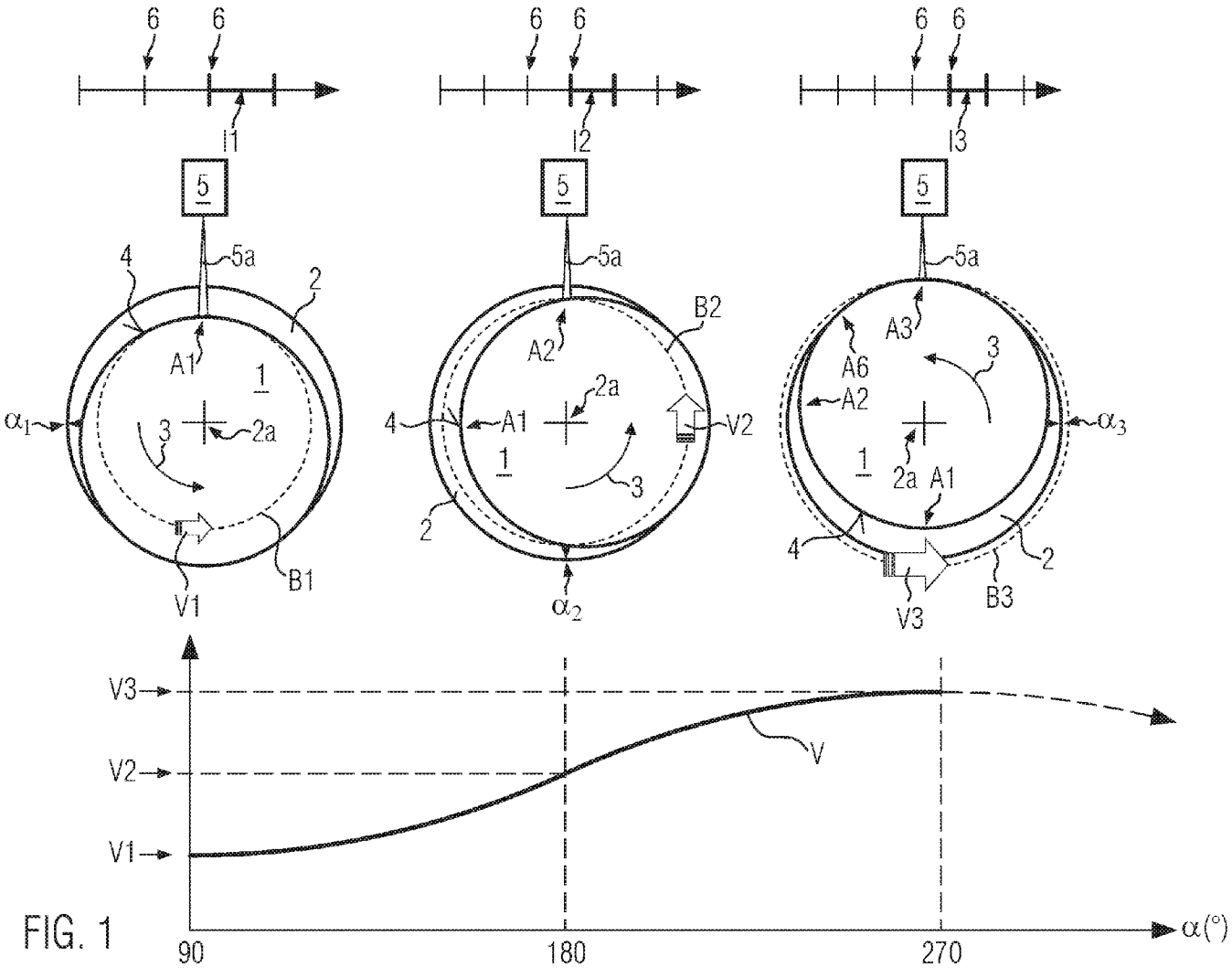
FIG. 1 shows a schematic representation of the measurement/adaptation according to the invention in plan view (at the center), measured distribution according to the invention of the local surface velocity along the container circumference (at the bottom) and adapted printing times (at the top)

FIG. 1 schematically shows velocity measurement according to the invention at a container 1 shown in top view which is rotated about itself about an axis of rotation 2*a* of a positioning unit 2 at an angular velocity 3. Due to an eccentric position and/or shape of a lateral surface 4 of container 1 relative to axis of rotation 2*a*, partially circumferential portions A1-A3 of lateral surface 4 being denoted by way of example circulate along paths B1-B3 at different surface velocities V1-V3. This is schematically indicated in FIG. 1 by block arrows having different sizes. Associated rotational positions $\alpha$

1-$\alpha$3 of container 1 are marked on positioning unit 2.

The different surface velocities V1-V3 are caused by the radial distances of lateral portions A1-A3 from rotational axis 2*a*. In the example shown, lateral portion A1 has the smallest radial distance from axis of rotation 2*a* and lateral portion A3 has the largest radial distance. Different radial distances of lateral wall regions occur due to the manufacturing process, for example, for glass bottles, which are clamped in at their mouths in a centered manner with respect to axis of rotation 2*a*.

With the aid of a measuring device 5, in the example shown operating in a contactless manner by way of a schematically indicated scanning beam 5*a*, which is for example a laser beam or an ultrasonic beam, the distribution of the local surface velocities V along a circumferential line of surface 4 may be measured along the entire circumference while container 1 rotates continuously. Surface velocities V1-V3 of partially circumferential portions A1-A3, illustrated by way of example, are obtained as partial results.

The spatial resolution of the velocity measurement according to the invention can be adapted to the requirements of ink-jet printing. Portion A6 being located between lateral portions A2 and A3 is indicated by way of example, the surface velocity of which could be measured as well as calculated by interpolation of readings, for example, surface velocities V2 and V3, or in another way.

The course of the local surface velocity V of sampled lateral surface 4 is illustrated as a function of the rotational position α for rotation about axis of rotation 2*a* (exaggerated for reasons of clarity) shown in FIG. 1 at the bottom. The local surface velocities V measured between rotational positions α1-α3 and associated partially circumferential portions A1-A3 are shown as a solid line. The further course is indicated by dashes.

If the print advance in front of a print head was created by the rotation indicated in FIG. 1 at angular velocity 3 and for unchanged eccentricity of surface 4 with respect to axis of rotation 2*a*, then this would with conventional actuation of individual print nozzles at constant time intervals between individual printing times, at which ink droplets are by definition ejected, with increasing local surface velocity V result in decreasing print resolution, i.e., in a larger spacing in the advance direction between the droplets placed on surface 4, and vice versa.

As indicated in FIG. 1 at the top, this is counteracted according to the invention in that the temporal sequence of printing times 6 for individual partially circumferential portions of lateral surface 4 is adapted to the respectively associated local surface velocity V. This means, for printing onto partially circumferential portions A1-A3 shown by way of example, the length of time intervals I1-I3 between individual printing times 6 of a particular nozzle or nozzle row aligned transverse to the print direction is adapted to the associated surface velocities V1-V3. The adaptation according to the invention of printing times 6 is in FIG. 1 schematically indicated along a linear time axis above associated lateral portions A1, A2 and A3.

In the example, the longest time intervals I1 between print commands to a particular nozzle or nozzle row are used for printing onto partially circumferential portion A1 with the lowest surface velocity V1, and conversely, the shortest time interval I3 between individual print commands to the same nozzle or nozzle row for printing onto partially circumferential portion A3 with the highest surface velocity V3. The time intervals between the print commands for individual nozzles or nozzle rows of a printhead are respectively shorter, the faster the partially circumferential portion of the lateral surface 4 to be printed on moves relative thereto in the advance direction. A common starting point for the adaptation of printing times 6 according to the invention can be a time interval between individual printing times that is typical of the performance of the printhead used.

Figure 2:
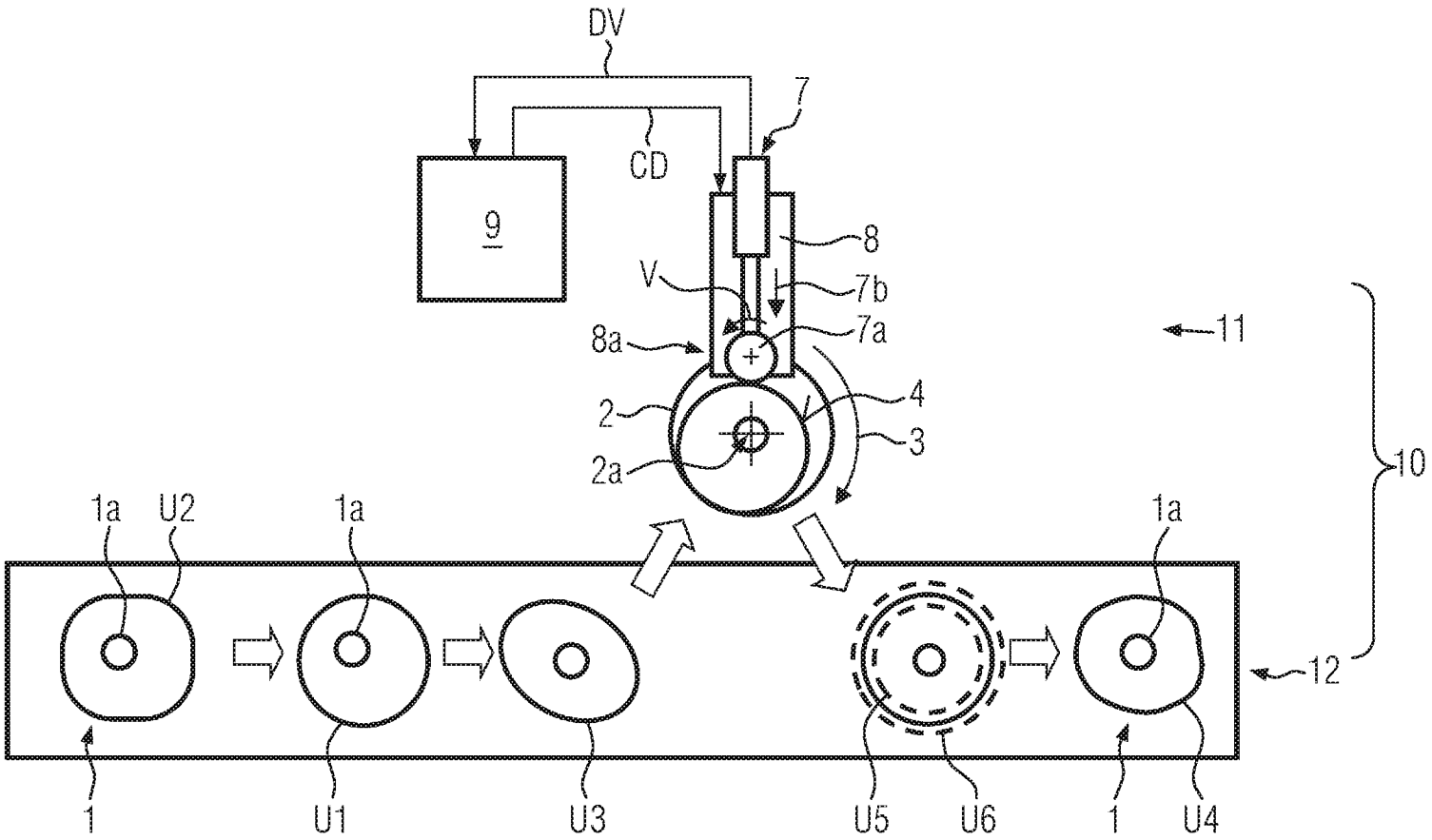
FIG. 2 shows a schematic plan view of a first example embodiment of the device according to the invention.

FIG. 2 shows velocity measurement according to the invention by use of a measuring device 7 comprising a friction wheel 7*a* that rolls along lateral surface 4 of container 1. Both lateral surface 4 as well as the tread area of friction wheel 7*a* then move at local surface velocity V within the meaning of a print advance relative to a print module 8. Measuring device 7 comprises, for example, a rotary encoder that transmits readings DV regarding local surface velocity V at the friction wheel 7*a* to a control unit 9 or the like. The latter further serves to control print module 8, comprising at least one schematically indicated printhead 8*a*, with print commands CD to eject ink at printing times 6.

In one example, the control unit 9 includes instructions stored in memory that when executed cause the control unit 9 to carry out one or more routines described herein. The control unit 9 may receive signals (e.g. DV) from various sensors described herein (e.g., measuring device) and employ various actuators (e.g., printhead) to adjust the device based on the received signals and instructions stored on the memory of the control unit.

According to FIG. 2, a first example embodiment 10 of the invention comprises at least one stationary print station 11 with positioning unit 2, measuring device 7, print module 8 and control unit 9, and as well as a conveyor belt 12 or the like, from which containers 1 to be printed are passed in cycles to print station 11. Containers 1 are for this purpose, for example, at their mouths 1*a* by use of centering bells (not shown) or the like centered with respect to axis of rotation 2*a* of positioning unit 2. Printing according to the invention while measuring surface velocity V is likewise possible with the continuous transport of containers 1, for example, at circulating print stations 11. It would also be conceivable to move positioning unit 2 with the respective container 1 along print station 11, for example, along a linear transport path substantially according to conveyor belt 12. Surface velocity V can also in this case be sampled by measuring device 7 in a rolling or contactless manner.

Containers 1 can due to manufacturing tolerances regarding their mouths 1*a* have eccentric or other circumferential lines U1-U4 deviating from a rotationally-symmetrical cross-section and/or circumferential lines U5, U6 which due to dimensional tolerances vary to a degree relevant for print advance. This is in FIG. 2 shown exaggerated for better understanding. The adaptation according to the invention of printing times 6 and/or angular velocity 3, for example, improves direct printing on surfaces 4 having a substantially circular and eccentric circumferential line U1, a partially circumferential flattened circular circumferential line U2, an elliptical circumferential line U3, an irregularly extending circumferential line U4 and/or circumferential lines U5, U6 having a circumference differing upwardly or downwardly from a nominal value.

Friction wheel 7*a* may be resiliently preloaded in the direction toward lateral surface 4 to be sampled. An associated pressing force 7*b* is schematically indicated by an arrow. Friction wheel 7 thereby remains in frictional contact with lateral surface 4 to be sampled. In the embodiment shown, friction wheel 7 is mounted telescopically movable in the direction toward lateral surface 4. Mounting friction wheel 7*a* on a resiliently preloaded lever or the like would also be conceivable.

Depending on the expected deviation of lateral circumferential lines U1-U6 from a circle centered around rotational axis 2, print module 8 and/or printhead 8*a* can be mounted in a position that is defined relative to axis of rotation 2*a* or maintain a specific value or range of the print distance from surface 4. For example, printhead 8*a* could, following lateral surface 4 to be sampled, be moved on axis of rotation 2*a* toward or away from the latter. For this, printhead 8*a* would, for example, need to be mounted movably on a linear unit (not shown). The adjustment could be performed both by use of an electric motor that is present on the linear unit as well as by mechanically coupling printhead 8*a* or a comparable nozzle row onto friction wheel 7*a*. Friction wheel 7*a* and lateral surface 4 would then interact within the meaning of a guide roller and a guide curve to adjust printhead 8*a* following surface 4 in order to thereby maintain a constant printing distance.

The partially circumferential sections A1-A3 in FIG. 1 denoted by way of example can in a functionally similar manner be sampled with friction wheel 7*a* to measure the associated local surface velocities V1-V3 or generally the course of the local surface velocity V and to adapt the printing times 6 and/or the angular velocity 3 for the respectively associated partially circumferential portions A1-A3 and A6, as described above.

Measuring the local surface velocity V and adapting printing times 6 and/or angular velocity 3 can be effected by use of control unit 9 or like units during ongoing printing operations (on-the-fly). Adapted printing times 6 can then during continuous rotation of container 1 be successively used for printing operations of other printheads 8*a*, for example, for multi-color printing. Partial prints can using individual printheads 8*a* then be produced and/or joined seamlessly with uniform print resolution. Such partial prints comprise, for example, different color components of a color model or complementary image details of a print image. Adapted courses of the angular velocity 3 are particularly suitable for modular stations at each of which only one color component is printed, or only a certain treatment step is performed.

Correct offsets between cooperating nozzle rows or nozzle blocks can in any case be maintained by stabilizing the print advance rate according to the invention.

The circumferential distribution of the local surface velocity V is typical for the container 1 measured, or, depending on the manufacturing tolerance, for a particular type of container, and at a known angular velocity 3 of the container rotation depends only on the rotational position $\alpha$ of positioning unit 2 and container 1. By storing data relating to rotational position $\alpha$, printing times 6 adapted according to the invention can in principle be applied for any printheads 8*a* existing in the region of positioning unit 2.

With constant angular velocity 3, the printing times 6 adapted for a particular printhead could alternatively be adopted for other printheads in the region of positioning unit 2 in that the adapted printing times 6 are each delayed by a time offset associated with the respective further printhead. The readings can also be transferred into a coordinate system, for example, to a polar coordinate system, and be converted for different target print advance rates and/or courses of the rotational velocity/angular velocity 3.

Figure 3:
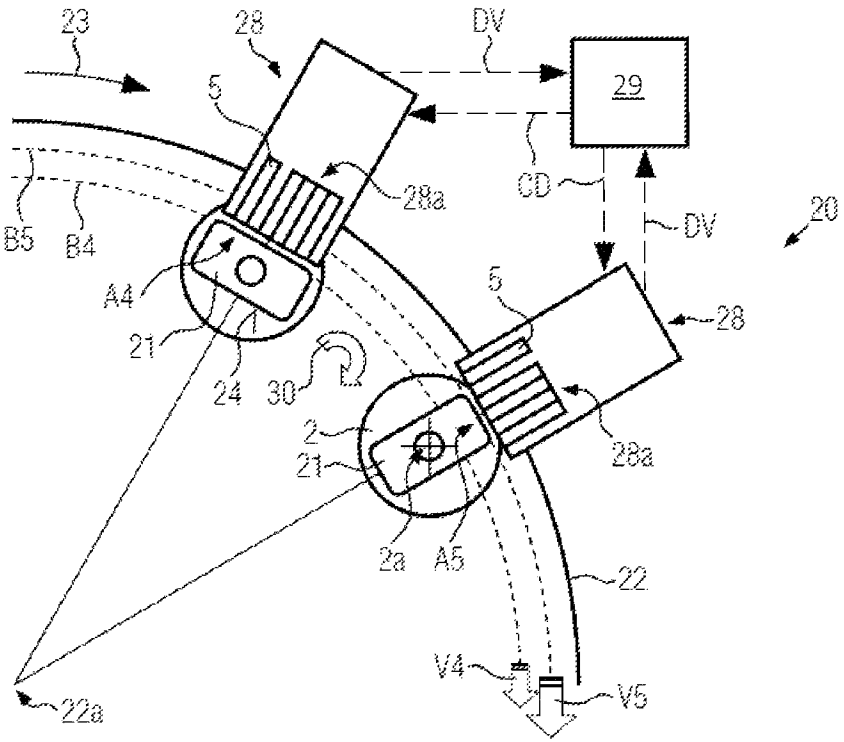
FIG. 3 shows a schematic plan view of a second example embodiment of the device according to the invention.

It would therefore in principle be sufficient to measure local surface velocity V only in front of the printhead 8*a* that is respectively first approached or at a separate measuring station, which could also be located outside the print station, and to apply adapted print times 6 and/or the adapted course of angular velocity 3 to further printheads in dependence of rotational position $\alpha$, angular velocity 3 and/or in a time-controlled manner. It would alternatively also be conceivable to configure multiple print modules 8 each having at least one measuring device 5, 7 in the region of positioning unit 2. FIG. 3 shows a second example embodiment 20 of the device according to the invention in which containers 21, may be formed as shaped bottles made of plastic or the like, each circulate continuously on a carousel 22 while being held by a positioning unit 2. Carousel 22 rotates at a known, in particular constant angular velocity 23.

Partially circumferential portions A4, A5 of a lateral surface 24 of containers 21 are directly printed successively at print modules 28 that are optionally mounted stationarily at the periphery of carousel 22 and composed of several nozzle rows 28*a* and/or printheads aligned transverse to the advance direction. Print modules 28 may be used for applying partial prints, for example, individual colors or image details of a print image.

A measuring device 5 which samples in a contactless manner is for measuring the local surface velocity V present upstream of nozzle rows 28*a* or functionally corresponding printheads, for example, integrated into print modules 28.

Lateral portions A4, A5 circulate along trajectories B4, B5 with carousel 22 and have different surface velocities V4, V5 due to different radial distances from axis of rotation 22*a* of carousel 22. This is for better understanding again indicated in FIG. 3 by block arrows of different sizes. Here as well, different surface velocities V4, V5 cause different print advance rates of lateral portions A4, A5 in front of print modules 28.

Containers 21 can additionally be rotated about themselves in front of print modules 28 at angular velocity 3, so that the print advance of the transport motion and the rotational motion of containers 21 is superimposed. In particular in this case, different surface velocities and print advance rates of individual lateral portions A4, A5 arise.

These different print advance rates can according to the invention be compensated by actuating nozzle rows 28*a* or functionally comparable printheads with printing commands CD to eject ink droplets at adapted printing times 6 in order to create a uniform print resolution in the advance direction. Time intervals between printing times 6 of individual nozzles or nozzle rows for printing partially circumferential portions of lateral surface 24 are for this in analogy to the rotation of containers 1 set respectively shorter, the higher the measured/calculated local surface velocity V. Alternatively or additionally, the course of angular velocity 3 can be used to stabilize the print advance rate, see first embodiment.

For the evaluation of readings DV of measuring device 5, a control unit 29 is present which additionally outputs print commands CD to nozzles rows 28*a* of print modules 28. In the example of FIG. 3, containers 21 are not rotated about themselves during the printing process, i.e. in the region of print modules 28. Rotational position $\alpha$ of containers 21 is instead prior to reaching print modules 28 adjusted by rotational positioning 30 by way of positioning units 2 which is actuated, for example, by control unit 29.

In one example, the control unit 29 includes instructions stored in memory that when executed cause the control unit 29 to carry out one or more routines described herein. The control unit 29 may receive signals (e.g. DV) from various sensors described herein (e.g., measuring device) and employ various actuators (e.g., nozzle rows of print modules) to adjust the device based on the received signals and instructions stored on the memory of the control unit.

Containers 1 having a rotationally-symmetrical nominal cross-section could with the second embodiment 20 of the device according to the invention likewise be directly printed on. Local surface velocities V of individual partially circumferential portions of lateral surface 4 could then arise, for example, by superimposing a rotation of containers 1 about themselves (at angular velocity 3 about axis of rotation 2*a* of positioning units 2) and a circulation of containers 1 on carousel 22 (at angular velocity of 23 about axis of rotation 22*a*).

Both a container rotation about itself as well as transportation on carousel 22 each cause curved trajectories B1-B3 or B4 and B5, respectively, of lateral surfaces 4, 24 of containers 1, 21. At a constant angular velocity 3, 23, different print advance rates therefore occur in both cases depending on the radius of curvature of the trajectories in front of a print head 8*a*/a nozzle row 28*a* and can according to the invention be compensated.

Irrespective of which proportion of the respectively arising pint advance rate the rotational motions of containers 1, 21 about themselves and the container transport have, for example, along a linear conveyor path or when circulating around carousel 22, local surface velocities V for lateral container surfaces 4, 24 can be measured with measuring device 5, 7 according to the invention and used for adapting printing times 6 according to the invention. This can occur both in real time/on-the-fly at individual print modules 8, 28, and/or the adapted printing times 6 are with the rotational position α of the individual positioning units 2 stored in control unit 9, 29 or the like in order to use the adapted printing times 6 in dependence of the rotational position α of positioning units 2 and associated containers 1, 21 when reaching further printheads 8*a*/nozzle rows 28*a* in the region of positioning unit 2 and/or of carousel 22.

A printing distance varying due to the container cross-section can be taken into account by additional temporal offset of printing times 6 in that run-time differences of individual ink droplets up to the respective partially circumferential portion A1-A5 of side container surfaces 4, 24 are compensated.

Lateral surfaces 4, 24 can be sampled both continuously by use of friction wheel 7*a* as well as in a contactless manner by use of a beam 5*a*, for example, in the form of laser light or ultrasonic waves. Local surface velocity V could also be measured by imaging, for example, by use of a camera and digital image evaluation (not shown).

Embodiments 10, 20 described can be there by combined at random in a technically meaningful way. In particular, rotational motions of containers 1, 21 about themselves and transport motions along curved paths can be combined almost as desired, in particular when adapting the printing times in real time/on-the-fly according to the invention.

Print modules 8, 28 could also rotate together with positioning units 2 and containers 1, 21 on a carousel.

Figure 4:
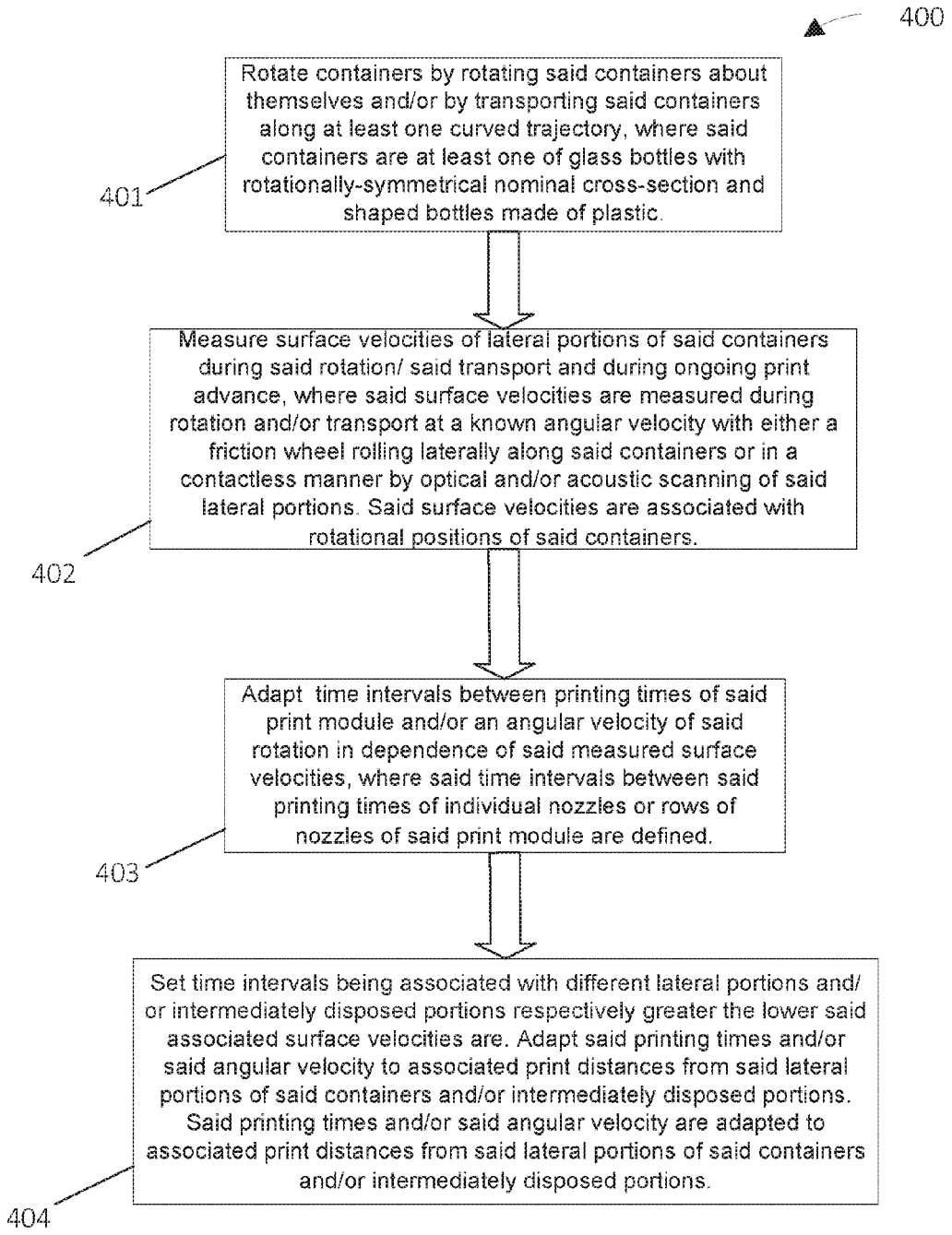
FIG. 4 shows a flow chart of an example method of operation according to the invention.

FIG. 4 shows a flow chart of an example method of operation 400 according to the present invention. At block 401, containers are rotated by rotating said containers about themselves and/or by transporting said containers along at least one curved trajectory, where said containers are at least one of glass bottles with rotationally-symmetrical nominal cross-section and shaped bottles made of plastic.

At block 402, the surface velocities of lateral portions of said containers are measured during said rotation/said transport and during ongoing print advance, where said surface velocities are measured during rotation and/or transport at a known angular velocity with either a friction wheel rolling laterally along said containers or in a contactless manner by optical and/or acoustic scanning of said lateral portions. Said surface velocities are associated with rotational positions of said containers.

At block 403, time intervals between printing times of said print module and/or an angular velocity of said rotation are adapted in dependence of said measured surface velocities from block 402, where said time intervals between said printing times of individual nozzles or rows of nozzles of said print module are defined.

At block 404, time intervals being associated with different lateral portions and/or intermediately disposed portions are set respectively greater the lower said associated surface velocities are. Said printing times and/or said angular velocity are then adapted to associated print distances from said lateral portions of said containers and/or intermediately disposed portions. Said printing times and/or said angular velocity are adapted to associated print distances from said lateral portions of said containers and/or intermediately disposed portions.

An operation method according to the invention for the embodiments shown in the FIGS. 1-4 is described below. The control methods and routines disclosed herein may be stored as executable instructions in non-transitory memory and may be carried out by the control unit in combination with the various sensors, actuators, and other hardware.

The method includes, for ink-jet printing onto containers, where a print advance with respect to at least one print module is created at least by rotation of said containers about themselves and/or by transporting said containers along at least one curved trajectory, where surface velocities of lateral portions of said containers are measured during said rotation/said transport, and where time intervals between printing times of said print module and/or an angular velocity of said rotation are adapted in dependence of said measured surface velocities.

An example of the method further includes said containers being transported along a continuous line; and said surface velocities being measured via a measuring device during said rotation at a first portion of the continuous line, wherein the first portion of the continuous line is upstream a print module first approached by said containers.

Another example of the method further comprises where said surface velocities of said containers transported along the at least one curved trajectory are measured via a measuring device upstream a print module first approached by said containers.

Another example of the method further includes where said surface velocities are measured via a measuring device in front of a print module first approached by said containers.

Another example of the method further includes wherein there is a plurality of print modules, with more than one print module configured to have a measuring device; and said surface velocities measured by the plurality of print modules configured with the measuring device.

The adaptation according to the invention of printing times is applicable irrespective of how individual nozzles, nozzle rows 28*a* or print heads 8*a* are distributed on print modules 8, 28. Based on the measurement of the surface velocities according to the invention, several printheads, nozzles rows and/or nozzle blocks interacting in a combined manner can be controlled either individually or jointly, for example, for printing widths above 70 mm.

Stabilization of the print advance rate according to the invention is possible both by adapting intervals I1-I3 between individual printing times 6, within the meaning of a print frequency, as well as by adapting and/or readjusting angular velocity 3/the rotational velocity of the containers about themselves.

The invention claimed is:

1. A method for ink-jet printing onto containers, where a print advance with respect to at least one print module is created at least by rotation of said containers about themselves and/or by transporting said containers along at least one curved trajectory, where surface velocities of lateral portions of said containers are measured during said rotation/said transport and fluctuations of the surface velocity of individual lateral portions, caused by eccentrically held and/or non-rotationally-symmetrical container cross-sections, are measured upstream of the ink-jet printing onto the containers, and where time intervals between printing times of said print module and/or an angular velocity of said rotation are adapted in dependence of said measured surface velocities, where time intervals between printing times of individual nozzles or rows of nozzles of said print module are defined, and wherein the measured surface velocities correspond to actual print advance rates of individual lateral portions of the containers relative to the print module.

2. The method according to claim 1, where time intervals associated with different lateral portions and/or intermediately disposed portions of said containers are set respectively greater the lower said associated surface velocities are.

3. The method according to claim 2, where said printing times and/or said angular velocity are adapted to associated print distances from said lateral portions of said containers and/or said intermediately disposed portions of said containers.

4. The method according to claim 3, where said containers are at least one of glass bottles with a rotationally-symmetrical nominal cross-section and shaped bottles made of plastic, and wherein the time intervals are adjusted by a temporal offset, the temporal offset based on the associated print distances.

5. The method according to claim 1, where said surface velocities are measured during ongoing print advance.

6. The method according to claim 5, where the printing times are adapted on-the-fly, during rotation at a constant angular velocity and in consideration of a time offset until a respective nozzle or nozzle row is reached.

7. The method according to claim 1, where said surface velocities are measured during rotation and/or transport at a known angular velocity.

8. The method according to claim 7, where said surface velocities are associated with rotational positions of said containers.

9. The method according to claim 7, where the known angular velocity is overlaid by a known transport velocity.

10. The method according to claim 1, where said surface velocities are measured with a friction wheel rolling laterally along said containers.

11. The method according to claim 1, where said surface velocities are measured in a contactless manner by optical and/or acoustic scanning of said lateral portions, the surface velocities being a sum of a rotational component due to the rotation and a translational component due to the transporting.

12. A device for ink-jet printing onto containers, comprising:

at least one print module;

at least one positioning unit for holding and rotating a container about itself in front of said print module;

at least one measuring device for measuring surface velocities of lateral portions of said rotating container;

wherein said measuring device operates in a contactless manner on the basis of an optical and/or acoustic scanning beam, and wherein time intervals are adjusted by a temporal offset, the temporal offset based on associated print distances; and a control device, said control device containing instructions for actuating said print module while adapting time intervals between printing times of said print module in dependence of said measured surface velocities, where time intervals between printing times of individual nozzles or rows of nozzles of said print module are defined, and wherein the measured surface velocities correspond to actual print advance rates of individual lateral portions of the containers relative to the print module.

13. The device according to claim 12, where said measuring device comprises a friction wheel with a rotary encoder, and where said friction wheel is resiliently preloaded in a direction toward said container having its surface velocity measured.

14. The device according to claim 13, where at least one print head on said print module is movably supported together with said friction wheel in the direction toward said container.

15. The device according to claim 12, where said optical scanning beam is at least one of a laser light, an optical code reader, a line scanner, and a camera; and where said acoustic scanning beam is an ultrasound acoustic scanning beam.

16. The device according to claim 12, where the control device adapts the printing times on-the-fly, during rotation at a constant angular velocity and in consideration of a time offset until a respective nozzle or nozzle row of the least one print module is reached.

17. A device for ink-jet printing onto containers, comprising:

at least one print module;

a carousel with positioning units circulating thereon for holding and rotating said containers about themselves;

at least one measuring device for measuring surface velocities of lateral portions of said circulating containers; and a control device for actuating said print module while adapting time intervals between printing times of said print module in dependence of said measured surface velocities, where time intervals between printing times of individual nozzles or rows of nozzles of said print module are defined, and wherein the measured surface velocities correspond to actual print advance rates of individual lateral portions of the containers relative to the print module;

and wherein the time intervals are adjusted by a temporal offset, the temporal offset based on associated print distances.

18. The device according to claim 17, where said measuring device operates in a contactless manner on the basis of an optical and/or acoustic scanning beam; where said optical scanning beam is at least one of a laser light, an optical code reader, a line scanner, and a camera; and where said acoustic scanning beam is an ultrasound acoustic scanning beam.

19. The device according to claim 17, where the at least one measuring device measures the surface velocities of the lateral portions at a known angular velocity of the lateral portions and at a known transport velocity of the lateral portions, the angular velocity and the transport velocity being overlaid with each other.

20. The device according to claim 17, where the at least one measuring device is positioned upstream of the at least one print module.

* * * * *